US011502446B2

(12) United States Patent
De Bolle et al.

(10) Patent No.: US 11,502,446 B2
(45) Date of Patent: Nov. 15, 2022

(54) DATA TRANSMISSION CONNECTOR AND A CORRESPONDING CONNECTOR ASSEMBLY, ELECTRIC CABLE AND USE THEREOF

(71) Applicant: NEXANS, Courbevoie (FR)

(72) Inventors: Luc De Bolle, Ternat (BE); Stefan Eisendrath, Lennik (BE); Martin Rossbach, Aachen (DE)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 17/327,303

(22) Filed: May 21, 2021

(65) Prior Publication Data

US 2021/0376518 A1 Dec. 2, 2021

(30) Foreign Application Priority Data

May 29, 2020 (EP) ..... 20 305 570

(51) Int. Cl.

| | |
|---|---|
| ***H01R 13/518*** | (2006.01) |
| ***H01R 13/502*** | (2006.01) |
| ***H01R 13/627*** | (2006.01) |
| ***H01R 31/06*** | (2006.01) |

(52) U.S. Cl.

CPC ..... *H01R 13/518* (2013.01); *H01R 13/502* (2013.01); *H01R 13/6271* (2013.01); *H01R 31/06* (2013.01)

(58) Field of Classification Search

CPC .. H01R 31/06; H01R 13/6271; H01R 13/518; H01R 13/502

See application file for complete search history.

(56) References Cited

U.S. PATENT DOCUMENTS

| | | | | |
|---|---|---|---|---|
| 6,988,914 | B2 * | 1/2006 | Pepe | H01R 31/02 439/76.1 |
| 7,025,636 | B2 * | 4/2006 | Allen | H01R 33/94 439/357 |
| 8,100,701 | B2 * | 1/2012 | Gerber | H01R 31/02 439/77 |
| 9,601,885 | B2 * | 3/2017 | Fransen | H01R 24/64 |
| 2004/0180580 | A1 | 9/2004 | Pepe et al. | |
| 2010/0009571 | A1 | 1/2010 | Scherer | |
| 2012/0309221 | A1 | 12/2012 | Scherer et al. | |
| 2013/0237100 | A1 * | 9/2013 | Affeltranger | H01R 13/6585 439/701 |

OTHER PUBLICATIONS

European Search Report dated Nov. 3, 2020.

* cited by examiner

*Primary Examiner* — Briggitte R. Hammond
(74) *Attorney, Agent, or Firm* — Sofer & Haroun, LLP

(57) ABSTRACT

A data transmission connector (103) has a housing (30) and a plurality of data transfer plug contacts (32) that are rigid and are arranged fixedly inside the connector (103).

12 Claims, 3 Drawing Sheets

DATA TRANSMISSION CONNECTOR AND A CORRESPONDING CONNECTOR ASSEMBLY, ELECTRIC CABLE AND USE THEREOF

RELATED APPLICATION

This application claims the benefit of priority from European Patent Application No. 20 305 570.2, filed on May 29, 2020, the entirety of which is incorporated by reference.

FIELD OF THE INVENTION

The present invention relates to a data transmission connector. It also relates to a connector assembly comprising such a data transmission connector, to an electric cable comprising such a connector assembly, as well as to the use of such a cable for data transmission in a telecommunications network.

The invention belongs to the general technical field of cable connectors and adapters. By way of non-limiting example, the invention may be used in applications relating to data transmission over telecommunications networks involving the carrying of high currents, such as in PoE (Power over Ethernet) data transmission applications.

DESCRIPTION OF RELATED ART

In data transmission, connecting adapters are usually required for splitting the plurality of high performance data transmission contact pairs (also referred to as "data transfer plug contact pairs"), for example four contact pairs, of a standardized cable or connector, into a plurality of single-pair (also referred to as "one-pair") connections, respectively associated with a plurality of single-pair connectors.

Such adapters are also known as "splitters" and such splitting is also known as "sharing".

Splitters should be able to maintain end-to-end the high performance and the shielding of cables and of connection elements.

In addition, splitters to be used in high current applications such as PoE should be able to carry the high currents required.

An adapter for standardized connectors with four contacts lying next to each other is known from document US 2010/0015858 A1. An overall view thereof is shown in the upper part of FIG. 1.

A flexible PCB (Printed Circuit Board) 33, also shown in an enlarged view in the bottom part of FIG. 1, is used for data signal transfer from jack contacts to single-pair contacts. Namely, in the inserted condition of the device, socket contacts of a standardized plug socket contact strip conductors on the flexible PCB 33. Thus, the flexible strip conductors function as adapter contacts.

Nevertheless, because of the reduced size of the intermediate flexible PCB 33, such a solution is limited to contacts located next to one another. This may not be the case in a number of cables or connectors.

In addition, such a solution has several deficiencies.

In particular, the fact that the PCB is flexible generates instability in the position, that is to say the orientation in space, as well as in the location of the contacts, which may result in lack of reliability of the connection and performance decrease.

Moreover, such adapter has several outer parts, carrying data signals where high currents flow. Outer parts are exposed to degradation, which may be detrimental to the quality of the connection and may even cause data transmission failure, not to mention the risk of injury for an operator or user.

OBJECTS AND SUMMARY

The present invention aims at remedying at least some of the above-mentioned deficiencies of the prior art.

To that end, the present invention provides a data transmission connector, comprising:

a housing;

a plurality of data transfer plug contacts;

remarkable in that the data transfer plug contacts are rigid and are arranged fixedly inside the connector.

Thus, not only is the connector according to the invention not specific to connections involving contacts lying next to each other, but in addition, it suppresses the need for an intermediate, flexible part. In the present invention, the plug contacts are rigid i.e. not flexible and they are fixed within the connector, which, as a result, forms a robust single part adapter.

Therefore, the connector according to the invention is an adapter that is particularly appropriate for splitting i.e. sharing data transfer plug contacts between two different connectors. This is because, in particular, due to the fixed arrangement of the data transfer plug contacts inside the connector, the latter provides a stable constellation of data transfer plug contacts, which guarantees reliability, high performance and repeatability of data transmission end-to-end and, more generally, high quality and performance of the connection.

According to a particular possible feature, the connector according to the invention may further comprise a contact separator.

That element of the connector facilitates splitting of the connections.

According to a particular possible feature, the contact separator may be made of metal.

Such material is particularly appropriate for reaching an optimized cost/durability/robustness and shielding efficiency compromise for the contact separator.

In a particular embodiment, the connector may further comprise a contact holder.

This makes it possible to further ensure that the data transfer plug contacts stay in a fixed position and location inside the connector, for optimal quality and performance of the connection.

In that embodiment, according to a particular possible feature, the contact holder may comprise a contact holder cover, which further contributes to maintaining the data transfer plug contacts in their desired fixed position and location inside the connector.

In that embodiment, according to a particular possible feature, the contact holder cover may comprise a plurality of contact holder cover parts that are mechanically assembled with each other, each part of the plurality of contact holder cover parts covering respectively one pair of data transfer plug contacts of the plurality of data transfer plug contacts.

This makes the contact holder cover modular. Such modularity makes it possible to ensure precise installation of each pair of data transfer plug contacts in its respective location inside the connector, as well as reinforced individual holding of each pair of data transfer plug contacts in position.

In a particular embodiment, the connector may further comprise a latch.

This has the advantage of guaranteeing robustness of the mechanical assembling with another connector, the contacts of which are to be split by the adapting connector according to the invention.

According to a particular possible feature, the housing of the data transmission connector according to the invention may be made of metal.

Such material is particularly appropriate for reaching an optimized cost/durability/robustness and shielding efficiency compromise for the connector.

In a particular embodiment, the connector according to the invention is an 8-way connector.

This makes the connector especially convenient for complete use of all the data transfer plug contacts when it is used as an adapter between the four wire pairs of a standardized cable/connector and a connector having four single-pair connections.

As a non-limiting example, the connector according to the invention may be an adapter compliant with standard IEC-60603-7-7:2010 published by IEC on May 1, 2010.

This makes the connector particularly well suited for use with any 8-way, shielded, free and fixed connectors for data transmission with frequencies up to 1000 MHz or even beyond, pursuant to and exceeding the provisions of Part 7-7 of standard IEC 60603, that is to say, standard IEC 60603-7-7:2010, as published by IEC (International Electrotechnical Commission) on May 1, 2010.

With the same aim as set forth above, the invention also provides a connector assembly, comprising:

a first data transmission connector, having four pairs of connection ports;

a second data transmission connector, having four single-pair connection ports distant from each other and each comprising one pair of connection ports; and a third data transmission connector, connecting the first and second connectors;

the connector assembly being remarkable in that the third connector is as succinctly described above.

By way of non-limiting example, the first connector may be compliant with a predetermined standard.

With the same aim as set forth above, the invention further provides an electric cable, remarkable in that it comprises a connector assembly as succinctly described above.

In a particular embodiment, the electric cable may be an Ethernet cable.

With the same aim as set forth above, the invention further proposes the use of such an electric cable in PoE (Power over Ethernet) data transmission over a telecommunications network.

The advantages and particular features of the connector assembly, of the electric cable and of the use thereof are similar to those listed above for the data transmission connector. They are therefore not repeated here.

BRIEF DESCRIPTION OF THE DRAWINGS

Other aspects and advantages of the invention will become apparent from the following detailed description of particular embodiments, which are given by way of non-limiting examples, with reference to the appended drawings, in which.

DETAILED DESCRIPTION

Figure 1:
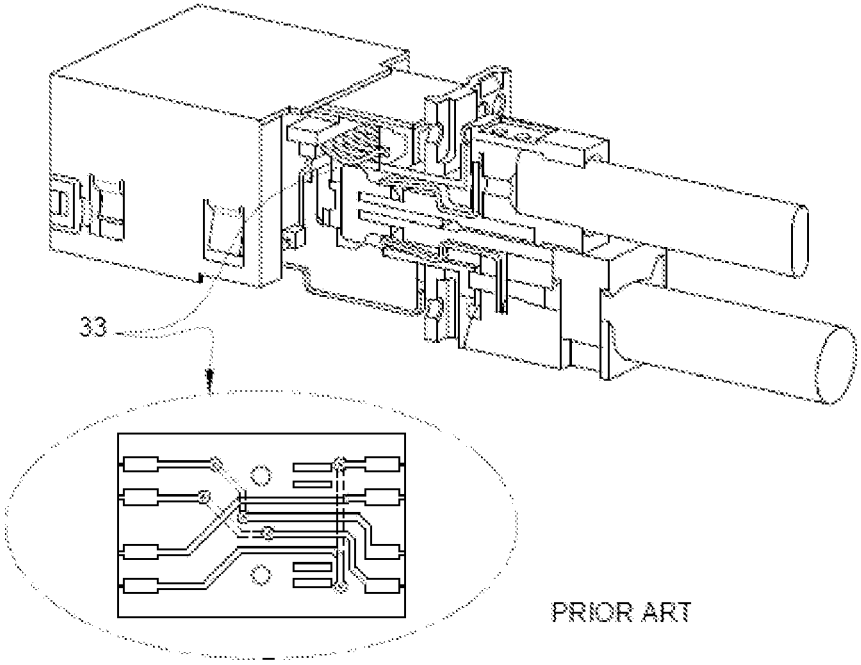
FIG. 1, already described, is a schematic view, partly in section, of a prior art socket with a prior art device for connecting a plurality of plugs to a standardized plug socket and with plugs inserted in the device.
Figure 2:
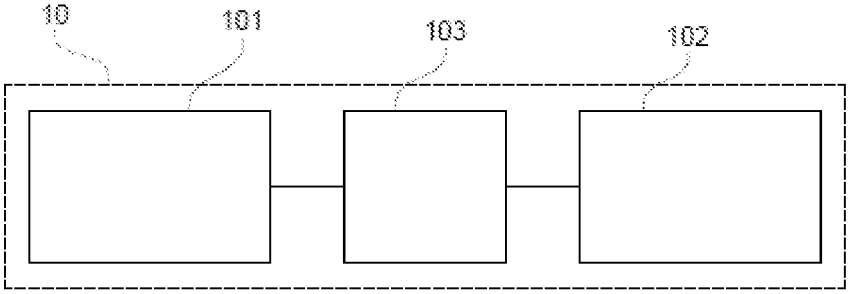
FIG. 2 is a synoptic view of a connector assembly according to the present invention, in a particular embodiment.

As shown in FIG. 2, a connector assembly 10 according to a particular embodiment of the present invention comprises a first connector 101, a second connector 102 and a third connector 103.

The first connector 101 is a data transmission connector having four pairs of connection ports.

In a particular embodiment, the first connector 101 may be a standardized connector i.e. it may be compliant with a predetermined standard.

The second connector 102 is a single-pair data transmission connector having four single-pair connection ports distant from each other, i.e. not lying next to one another. Each of the single-pair connection ports comprises one pair of connection ports.

According to the present invention, the third connector 103 is a data transmission connector which has the functions of an adapter, connecting the first and second connectors 101, 102 in a manner described in more detail below.

Thus, in the following, the data transmission connector according to the invention, which is the third connector 103 in FIG. 2, will also be referred to as an adapter.

Therefore, in the following:

the expressions "data transmission connector 103 according to the invention", "third connector 103" and "adapter 103" are synonymous and refer to the same element, which is the data transmission connector performing the functions of an adapter according to the present invention;

the expression "standardized data transmission connector" refers to the first connector 101, the connections of which are to be split by the adapter 103 according to the invention; and the expression "single-pair data transmission connector" refers to the second connector 102.

Figure 3:
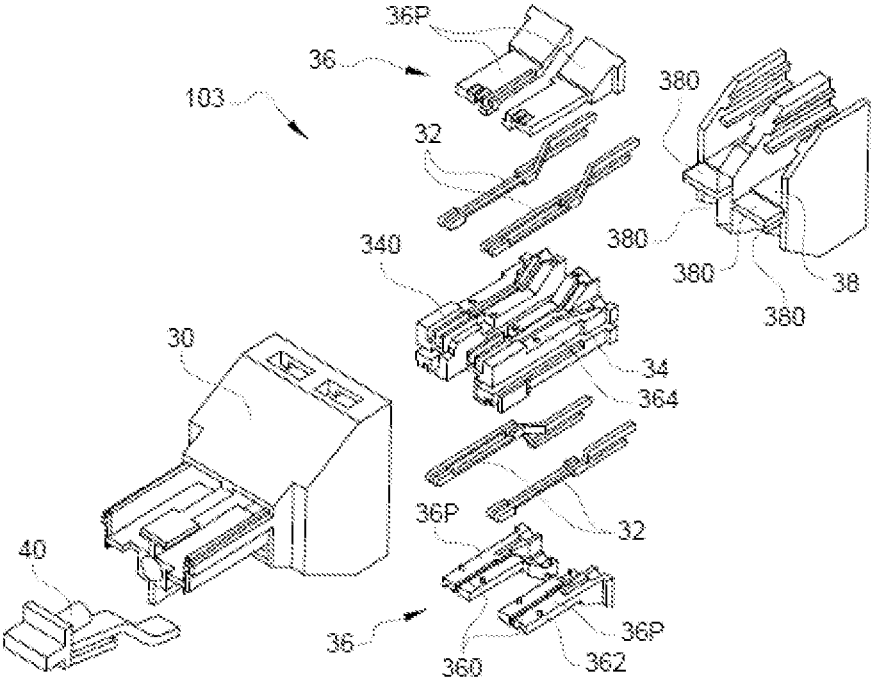
FIG. 3 is a schematic exploded view of a data transmission connector according to the present invention, in a particular embodiment.

With reference to FIG. 3, the data transmission connector 103 according to the invention comprises a housing 30.

The housing 30 is preferably, but not necessarily, made of metal, for optimizing the quality to cost ratio. Metal will offer satisfying durability, robustness and shielding efficiency. A large variety of metallic materials may be used.

By way of non-limiting example, the housing 30 may be made of aluminum and/or copper.

As a variant, it may be made of zamac, which is a zinc, aluminum, magnesium and copper alloy.

The data transmission connector 103 also comprises a plurality of data transfer plug contacts 32.

According to the present invention, the data transfer plug contacts 32 are rigid. In other words, they are not flexible. This makes them more solid and resistant to damage.

In addition, according to the present invention, the data transfer plug contacts 32 are arranged fixedly inside the data transmission connector 103, as described in more detail below.

As the data transfer plug contacts 32 are accommodated inside the data transmission connector 103, they are not exposed to outer environment, which reduces even more the risk of damage to the data transfer plug contacts 32 and to the connection to be realized.

In the particular embodiment shown in FIG. 3, the data transmission connector 103 further comprises a contact separator 38.

The contact separator 38 is accommodated inside the housing 30.

It is subdivided into several compartments 380 that each receive part of the data transfer plug contacts 32 and thus separate the data transfer plug contacts 32 into a predetermined number of groups of data transfer plug contacts 32. Each group comprises a predetermined number of data transfer plug contacts 32, as needed in the concerned connection. Each group is distant from another group i.e. is not lying next to another group.

Thus, the data transfer plug contacts 32 of a given group are distant from the data transfer plug contacts 32 of another given group.

This facilitates the splitting of the data transfer plug contacts 32 by the data transmission connector 103.

In addition, for any given group comprising more than one data transfer plug contact 32, the data transfer plug contacts 32 of that group are also distant from each other i.e. are not laying next to one another.

This further facilitates the splitting of the data transfer plug contacts 32 by the data transmission connector 103.

In the particular embodiment of FIG. 3, there are four pairs of data transfer plug contacts 32 and the contact separator 38 has four compartments 380. Each compartment 380 receives a pair of data transfer plug contacts 32 and thus separates the four pairs of data transfer plug contacts 32 from each other.

In such an embodiment, the data transmission connector 103 is therefore an 8-way connector, but this is a non-limiting example.

The contact separator 38 is preferably, but not necessarily, made of metal, for optimizing the quality to cost ratio. Metal will offer satisfying durability, robustness and shielding efficiency. A large variety of metallic materials may be used.

By way of non-limiting example, the contact separator 38 may be made of aluminum and/or copper.

As a variant, it may be made of zamac, which is a zinc, aluminum, magnesium and copper alloy.

In the particular embodiment shown in FIG. 3, the data transmission connector 103 further comprises a contact holder 34, accommodated inside the housing 30 and inserted in the contact separator 38.

The contact separator 38 and the contact holder 34 may have side walls provided with respective complementary shapes, such as ribs and grooves, as shown in FIG. 3, through which they can slide with respect to each other during assembling. This enables insertion of the contact holder 34 into the contact separator 38 in a well-defined position.

In the particular embodiment of FIG. 3, the contact holder 34 further has contact holder grooves 340, receiving the data transfer plug contact pairs 32. The shape of a given contact holder groove 340 generally corresponds to the shape of the data transfer plug contact pair 32 received in that contact holder groove 340.

The contact holder 34 may be made of a single part. Alternatively, it may comprise several parts for modularity, which may facilitate mounting of the data transmission connector 103.

In the particular embodiment shown in FIG. 3, the contact holder 34 further comprises a contact holder cover 36.

The contact holder cover 36 may comprise a plurality of contact holder cover parts 36P, each part 36P covering respectively one pair of data transfer plug contacts 32 of the plurality of data transfer plug contacts 32.

By way of non-limiting example, for assembling with each other, two adjacent contact holder cover parts 36P may be provided with complementary shapes, fitting into each other.

As a variant, they may be assembled with each other through any means, such as screws or glue.

Optionally, contact holder cover parts 36P may further be provided with a predetermined number of pins 362, inserted in corresponding holes 364 provided in the contact holder 34.

In the embodiment of FIG. 3, two pins 362 are provided on each contact holder cover part 36P (only the four pins 362 provided on the two bottom contact holder cover parts 36P are visible) and eight corresponding holes 364 are provided on the contact holder 34 (only the four holes 364 respectively receiving the four pins 362 provided on the two top contact holder cover parts 36P are visible).

In addition, as shown in the particular embodiment of FIG. 3, each contact holder cover part 36P may have contact holder cover grooves 360 receiving the data transfer plug contact pairs 32 for holding them in position. The shape of a contact holder cover groove 360 generally corresponds to the shape of the data transfer plug contact pair 32 received in that contact holder cover groove 360.

Moreover, as also shown in the particular embodiment of FIG. 3, the data transmission connector 103 may optionally further comprise a latch 40, fitting for example into the back side of the housing 30, that is to say the side of the data transmission connector 103 opposite to the contact separator 38.

The two branches of each of the data transfer plug contact pairs 32 are adjacent on a first predetermined length of the contact pair and split so as to be distant from each other and oriented in a predetermined manner on a second predetermined length of the same contact pair, so as to be arranged as described below in more detail with reference to FIG. 5.

Figure 4:
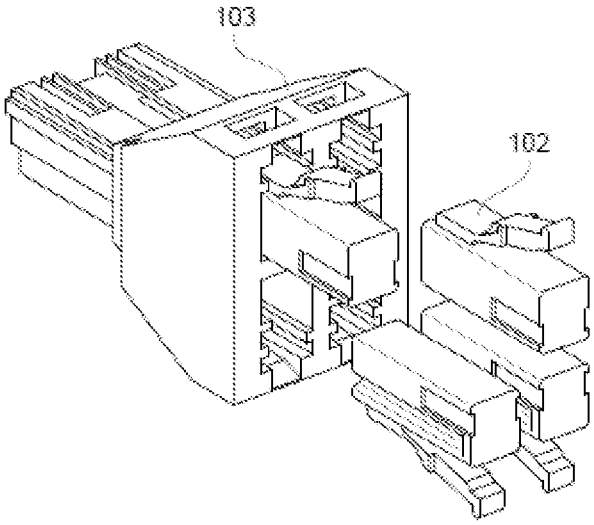
FIG. 4 is a schematic perspective view of part of a connector assembly according to the present invention.

FIG. 4 schematically illustrates part of the data transmission connector 103, with one of four single-pair connections of the single-pair connector 102 inserted therein and the three other single-pair connections of the single-pair connector 102 not inserted, for better legibility of the drawing and for facilitating understanding of the invention.

Figure 5:
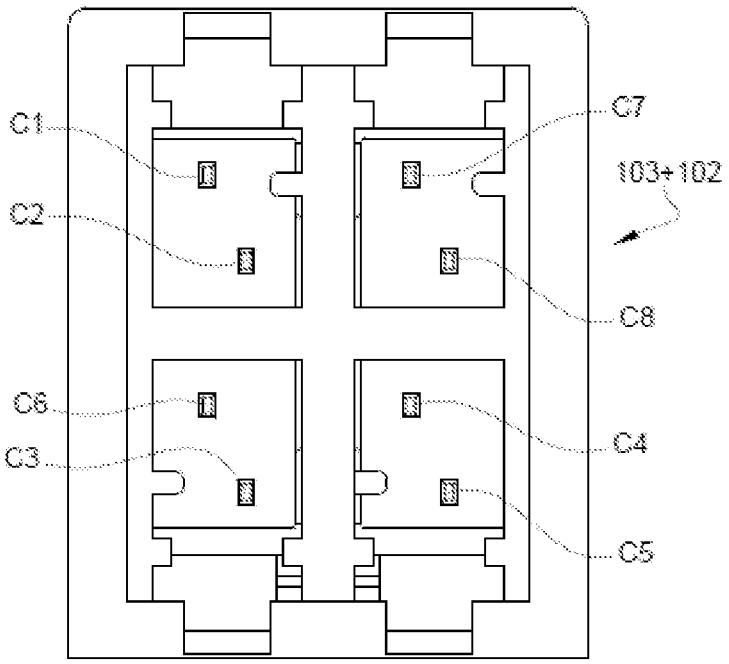
FIG. 5 is a schematic front view of the part of the connector assembly shown in FIG. 4.
Figure 6:
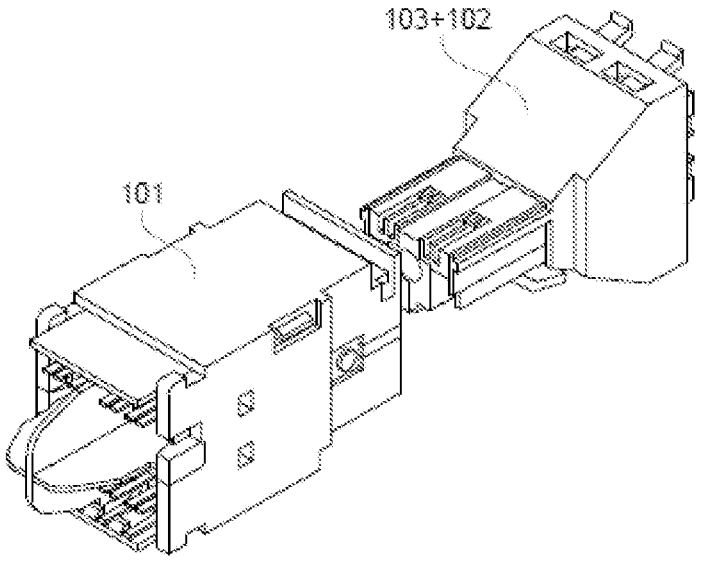
FIG. 6 is a schematic perspective view of part of a connector assembly according to the invention in a particular embodiment, showing a data transmission connector according to the invention and a standardized four-pair connector the pairs of which are to be split by means of the data transmission connector.

A non-limiting example of the arrangement of the data transfer plug contacts 32 is illustrated by FIG. 5, in a particular embodiment where there are eight data transfer plug contacts 32, designated by reference signs C1 to C8.

FIG. 5 is a schematic front view of the parts of the data transmission connector 103 and of the single-pair connector 102 shown in FIG. 4. More particularly, FIG. 5 illustrates the fixed, well-defined positioning, location and separation of the data transfer plug contacts 32, which are separated in four groups, each group comprising a pair of data transfer plug contacts 32, as follows:

(C1, C2) on top left of FIG. 5, with C1 in the upper part of the concerned single-pair connection of the single-pair connector 102 and C2 in the lower part of that single-pair connection, (C7, C8) on top right, with C7 in the upper part of the concerned single-pair connection of the single-pair connector 102 and C8 in the lower part of that single-pair connection, (C6, C3) on bottom left, with C6 in the upper part of the concerned single-pair connection of the single-pair connector 102 and C3 in the lower part of that single-pair connection, and (C4, C5) on bottom right, with C4 in the upper part of the concerned single-pair connection of the single-pair connector 102 and C5 in the lower part of that single-pair connection.

As shown in FIG. 5, the data transfer plug contacts 32 are arranged in the four corners of the adapter 103.

The connector 103 according to the invention may be used for example in the field of structured cabling systems. As known by a person skilled in the art, a structured cabling system is a complete system of cabling and associated hardware, which provides a comprehensive telecommunications infrastructure. Such infrastructure is usually not device dependent and serves a wide range of uses, such as telephony or data transmission through a computer network.

Structured cabling design and installation is governed by a set of standards that specify wiring data centers, offices, and apartment buildings for data or voice communications using various kinds of cables, fiber optic cabling, modular connectors, etc.

The invention may be used in such a structured cabling system, when for example a standardized four-pair link is needed.

As a non-limiting example, a single-pair Ethernet telecommunications network is one among many other fields of application of the invention.

As a non-limiting example, the data transmission connector 103 according to the invention may be used with standardized connectors of the Cat7, GG45 type and with standardized connectors of the Cat7-only connector, as an adapter compliant with standard IEC-60603-7-7:2010 published by IEC (International Electrotechnical Commission) on May 1, 2010, such as an IEC-60603-7-7:2010 front-end adapter.

An electric cable according to the invention comprises at least one connector assembly 10 as described above.

In a particular embodiment, the electric cable according to the invention may be an Ethernet cable.

Such an Ethernet electric cable may be used in PoE (Power over Ethernet) data transmission over a telecommunications network.

The invention claimed is:

1. A data transmission connector, comprising:

a housing;

a plurality of data transfer plug contacts that are rigid and are arranged fixedly inside said connector;

a contact holder comprising a contact holder cover;

wherein said contact holder cover comprises a plurality of contact holder cover parts that are mechanically assembled with each other, each part of said plurality of contact holder cover parts covering respectively one pair of data transfer plug contacts of said plurality of data transfer plug contacts.

2. The connector according to claim 1, wherein said connector further comprises a contact separator.

3. The connector according to claim 2, wherein said contact separator is made of metal.

4. The connector according to claim 1, wherein said connector further comprises a latch.

5. The connector according to claim 1, wherein said housing is made of metal.

6. The connector according to claim 1, wherein said connector is an 8-way connector.

7. The connector according to claim 1, wherein said connector is an adapter compliant with standard IEC-60603-7-7:2010 published by IEC on May 1, 2010.

8. A connector assembly, comprising:

a first data transmission connector, having four pairs of connection ports;

a second data transmission connector, having four single-pair connection ports distant from each other and each comprising one pair of connection ports; and a third data transmission connector, connecting said first and second connectors; wherein said third connector is according to claim 1.

9. The connector assembly according to claim 8, wherein said first connector is compliant with a predetermined standard.

10. An electric cable, wherein said electric cable comprises the connector assembly according to claim 8.

11. The electric cable according to claim 10, wherein said electric cable is an Ethernet cable.

12. A telecommunications network, comprising the electric cable according to claim 11 for PoE, Power over Ethernet, data transmission.

* * * * *